US010648243B1

(12) United States Patent
Burrows

(10) Patent No.: US 10,648,243 B1
(45) Date of Patent: May 12, 2020

(54) CASING STRING TORQUE TRANSFER AND SUSPENSION SYSTEM AND METHOD FOR MANDREL CASING HANGERS

(71) Applicant: Downing Wellhead Equipment, LLC, Oklahoma City, OK (US)

(72) Inventor: Steven Kim Burrows, Oklahoma City, OK (US)

(73) Assignee: Downing Wellhead Equipment, LLC, Oklahoma City, OK (US)

( * ) Notice: Subject to any disclaimer, the term of this patent is extended or adjusted under 35 U.S.C. 154(b) by 311 days.

(21) Appl. No.: 15/710,531

(22) Filed: Sep. 20, 2017

Related U.S. Application Data

(60) Provisional application No. 62/397,848, filed on Sep. 21, 2016.

(51) Int. Cl.
*E21B 17/08* (2006.01)
*E21B 17/02* (2006.01)
*E21B 17/16* (2006.01)

(52) U.S. Cl.
CPC ..... *E21B 17/08* (2013.01); *E21B 17/021* (2013.01); *E21B 17/16* (2013.01)

(58) Field of Classification Search
CPC ..... E21B 19/06; E21B 33/0415; E21B 33/14; F04D 13/022; F04D 13/10; F04D 29/044; F16D 1/10; F16D 3/02
See application file for complete search history.

(56) References Cited

U.S. PATENT DOCUMENTS 5,048,606 A * 9/1991 Allwin ..... E21B 23/01 166/208
5,472,055 A * 12/1995 Simson ..... E21B 23/01 166/208
6,467,547 B2 * 10/2002 Maguire ..... E21B 17/06 166/386
8,528,650 B1 9/2013 Smith et al.
(Continued)

OTHER PUBLICATIONS

Seaboard International, Inc., "Seaboard Rotating Torque Tool", taken from https://www.global.weir/assets/files/product%20brochures/Seaboard_brochure%20Rotating%20Torque%20Tool.pdf, Jun. 30, 2015, 1 page.

(Continued)

*Primary Examiner* — Daniel P Stephenson
(74) *Attorney, Agent, or Firm* — Frederic Dorwart, Lawyers PLLC; Penina Michlin Chiu

(57) ABSTRACT

A casing string torque transfer and suspension system and method for mandrel casing hangers. A running tool for a mandrel casing hanger suspending a casing string includes a pair of rotary drive rings secured around the running tool, a torque transfer ring of the pair of drive rings including a series of sloping teeth that removably couple to the mandrel casing hanger, the drive rings transferring torque to the casing string to rotate the casing string in a right-handed direction during one of running of the casing string, cementing of the casing string or a combination thereof, and the pair of rotary drive rings transferring axial loads to the casing string when the running tool is threaded to the mandrel casing hanger. Rotation of the rotary drive rings in a left-handed direction retracts the rotary drive rings as the running tool separates from the mandrel casing hanger.

21 Claims, 11 Drawing Sheets

(56) References Cited

U.S. PATENT DOCUMENTS

| | | | | |
|---|---|---|---|---|
| 8,721,181 | B2 | 5/2014 | Semple et al. | |
| 9,121,232 | B2 * | 9/2015 | Abraham | E21B 17/06 |
| 9,353,753 | B2 | 5/2016 | Wilson et al. | |
| 9,689,229 | B2 | 6/2017 | Hanson et al. | |
| 10,233,714 | B2 * | 3/2019 | Cheah | E21B 23/02 |
| 2012/0305269 | A1 * | 12/2012 | Bories | E21B 33/0415 166/382 |
| 2014/0311753 | A1 * | 10/2014 | Hanson | E21B 33/0415 166/378 |
| 2015/0152701 | A1 * | 6/2015 | Levert, Jr. | E21B 33/04 166/380 |
| 2017/0067320 | A1 * | 3/2017 | Zouhair | E21B 41/00 |
| 2017/0167218 | A1 * | 6/2017 | Cheah | E21B 23/02 |

OTHER PUBLICATIONS

Schlumberger Limited, "Rotating Mandrel Casing Hanger", taken from http://www.slb.com/~/media/Files/cameron/product-sheets/rotating-mandrel-casing-hanger.pdf, Dec. 15, 2016, 1 page.

* cited by examiner

CASING STRING TORQUE TRANSFER AND SUSPENSION SYSTEM AND METHOD FOR MANDREL CASING HANGERS

CROSS REFERENCE TO RELATED APPLICATIONS

This application claims the benefit of U.S. Provisional Application No. 62/397,848 to Burrows filed Sep. 21, 2016 and entitled "APPARATUS, SYSTEM AND METHOD FOR RUNNING OF A CASING STRING," which is hereby incorporated by reference in its entirety.

BACKGROUND OF THE INVENTION

1. Field of the Invention

Embodiments of the invention described herein pertain to the field of oil and gas well completion. More particularly, but not by way of limitation, one or more embodiments of the invention enable a casing string torque transfer and suspension system and method for mandrel casing hangers.

2. Description of the Related Art

Fluid, such as natural gas, oil or water, is often located in underground formations. In oil and gas wells, completion is the process of making the underground well ready for production or injection. The completion process conventionally involves preparing the bottom of the hole to the required specifications, running in and cementing the casing, running in the production tubing and its associated downhole tools, as well as perforating and stimulating as required.

Once a well has been drilled, the first step is to case the hole. Casing ensures that the well does not close in on itself once the drilling fluids are removed. Casing consists of steel pipe that is joined together to make a long, hollow tube. Typically, multiple approximately thirty-foot lengths of pipe are threaded together to create the casing string, which can be thousands of feet long depending on well depth, casing size and whether the casing is an outermost casing string or an intermediate casing string. The threaded connections are often referred to as collars. When assembled, the casing string weights hundreds of thousands of pounds and is lowered into the well by a drilling rig.

The casing string also includes a casing hanger. During casing installation, the casing string is lowered until the casing hanger is seated on a shoulder in the wellhead. Mandrel type casing hangers are often preferred to the alternative, which are known as slip-type casing hangers. The mandrel-type casing hanger suspends the casing from the wellhead, using the weight of the casing string extending below the mandrel casing hanger to secure the mandrel casing hanger on a shoulder of the wellhead housing. Once the casing string is in place suspended from the wellhead, the next step in well completion involves cementing the well. Cementing involves pumping cement slurry into the well to fill in the space between the casing and the sides of the drilled well, or to fill the space between an intermediate casing and the casing immediately outwards. Cementing seals the annulus after a casing string has been run into the wellbore and binds the casing to the well bore or formation, and to subsequent casing, to provide support to the completed well.

In order to lower and cement the casing string, a running tool is typically used to assist in suspending and reciprocating the casing string as required. The running tool consists of a cylindrical body that threads to the mandrel casing hanger on a bottom side of the running tool and is attached to manipulation casing on a top side of the running tool. The well casing to be run into the wellbore is threaded onto the bottom of the mandrel casing hanger. All of the threaded connections in the casing string are conventionally tightened by a right-handed rotation, and loosened with a left-handed rotation. Once the casing mandrel is lowered and seated in place on the wellhead housing, the running tool must be separated by a left-hand rotation. One problem that arises with this technique, however, is the left-handed rotation of the casing string to disengage the running tool must be accomplished with minimal torque due to concerns of backing off (unthreading the other connections in the casing string).

Another problem is the current running tool systems do not allow rotation of the casing string about its longitudinal axis. It is often beneficial to rotate a casing string while it is being run into the wellbore or during cementing. For example, during cementing, rotation of the casing string can ensure a casing bond of higher quality by improving the distribution of cement around the outer diameter of the casing. In another example, in horizontal wells, the casing must pass through a radius (or turn), and rotation of the casing is desirable when the casing is passing through the radius to keep the casing from sticking. However, conventional casing strings cannot be rotated with a right-hand rotation without applying too much torque to the running tool's threaded connection to the mandrel. Further, conventional casing strings cannot be sufficiently rotated to the left without concerns over prematurely detaching the running tool or unthreading the sections of casing that form the casing string.

It has been proposed to use a complex system of slots on the flange of a mandrel casing hanger, in combination with retractable dogs on a running tool, in order to provide a connection between the running tool and mandrel casing hanger that would permit rotation of the casing string. However, the proposed system has proved impractical because it requires an unmanageable amount of springs, pins and/or other small parts that must be assembled at the wellsite, and in addition, it is not readily adjustable for various casing sizes.

As is apparent from the above, current running tools for mandrel casing hangers do not adequately provide for both rotation and reciprocation of the casing string. Therefore, there is a need for an improved casing string torque transfer and suspension system and method for mandrel casing hangers.

BRIEF SUMMARY OF THE INVENTION

One or more embodiments of the invention enable a casing string torque transfer and suspension system and method for mandrel casing hangers.

A casing string torque transfer and suspension system and method for mandrel casing hangers is described. An illustrative embodiment of a casing string torque transfer and suspension system includes a pair of rotary drive rings secured circumferentially around a casing string running tool, the pair of rotary drive rings including a drive ring member coupled above a torque transfer ring member, a plurality of cushioning members positioned in a space between the drive ring member and the torque transfer ring member, the drive ring member secured to the casing string running tool, and the torque transfer ring member including a series of sloping teeth, each sloping tooth removably interspersed within fluid bypass flutes of a mandrel casing hanger. In some embodiments, the pair of rotary drive rings is rotatable between a torque transfer position, wherein when the rotary drive rings are rotated in a first direction, the pair of rotary drive rings transfer torque from the casing string running tool to a casing string secured below the mandrel casing hanger, and a retracted position, wherein when the casing string running tool is rotated in a second direction the rotary drive rings retract to separate the casing string running tool from the mandrel casing hanger. In certain embodiments, in the retracted position the plurality of cushioning members compress and the series of sloping teeth disengage from the fluid bypass flutes. In some embodiments, a sloped side of each sloping tooth of the series of sloping teeth slides along a beveled corner of a particular fluid bypass flute of the fluid bypass flutes as the series of sloping teeth disengage from the fluid bypass flutes to actuate into the retracted position. In certain embodiments, the casing string running tool is threadably connected to the mandrel casing hanger and a casing string is suspended below the mandrel casing hanger. In some embodiments, the mandrel casing hanger seats on a shoulder of a wellhead housing at a surface of a downhole well, and further including a casing string threaded to the mandrel casing hanger, the casing string extending into the downhole well. In certain embodiments, each sloping tooth further includes an axially extending edge parallel to a first wall of a particular fluid bypass flute in which the sloping tooth is removably interspersed, and a sloping edge opposite the axially extending edge, the sloping edge spaced from a second wall of the particular fluid bypass flute, the second wall parallel to the first wall and the sloping edge extending at about a forty-five degree angle from the second wall. In some embodiments, a top corner of the second wall is beveled at about same angle as the sloping edge. In certain embodiments, rotating the rotary drive rings in a first direction abuts the axially extending edge against the first wall to transfer torque from the casing string running tool to a casing string secured below the mandrel casing hanger, and wherein rotating the rotary drive rings in a second direction slides the sloping edge along the second wall as the rotary drive rings retract to disengage the casing string running tool from the mandrel casing hanger. In some embodiments, the pair of rotary drive rings transfer an axial load to a casing string secured below the mandrel casing hanger.

An illustrative embodiment of a casing string torque transfer and suspension system includes a running tool threadable to a mandrel casing hanger, the mandrel casing hanger including a casing string threaded to the mandrel casing hanger and extending below the mandrel casing hanger, a plurality of flutes dispersed circumferentially around a flange of the mandrel casing hanger, and a pair of rotary drive rings extending around an outer diameter of one of the running tool, the mandrel casing hanger or a combination thereof, the pair of rotary drive rings including an upper drive ring member pinned to the outer diameter of the running tool, and a lower driven ring member interlocked to the upper ring member below the upper ring member, the lower driven ring member including a set of protruding portions, each protruding portion of the set of protruding portions extending into one of the flutes when the running tool is threaded to the mandrel casing hanger. In some embodiments, each flute includes a pair of axially extending walls, and each protruding portion further includes an axially extending side parallel to a first axially extending wall of the pair of axially extending walls, the axially extending side abuttable against the first axially extending wall such that rotation of the running tool in a first direction transfers torque through the abutment and rotates the casing string, and a sloping side opposite the axially extending side and spaced from a second axially extending wall of the pair of axially extending walls, such that rotation of the running tool in a second direction disengages the running tool from the mandrel casing hanger. In some embodiments, the casing string torque transfer and suspension system includes a bevel on a top corner of the second axially extending wall, wherein during rotation of the running tool in the second direction, the sloping side slides along the bevel as the lower driven ring member moves upward. In certain embodiments, the first direction is a right-handed rotation and the second direction is a left-handed rotation when viewed from above the casing string. In some embodiments, the flange of the mandrel casing hanger is seatable on a wellhead housing shoulder. In certain embodiments, each flute of the plurality of flutes is a fluid bypass flute. In some embodiments, the casing string torque transfer and suspension system further includes a first set of rectangular teeth extending downward from the upper drive ring member, the first set of rectangular teeth interlocking with a second set of rectangular teeth that extend upward from the lower driven ring member, and a plurality of cushioning members extending axially between the upper drive ring member and the lower driven ring member, the plurality of cushioning members dispersed circumferentially around the pair of rotary drive rings. In certain embodiments, each cushioning member of the plurality of cushioning members extends from a rectangular tooth of the lower driven ring member into a trough of the first set of rectangular teeth of the upper drive ring member.

An illustrative embodiment of a torque transfer and suspension tool for a mandrel type casing hanger suspending a casing string into a downhole well includes a pair of rotary drive rings secured around an outer diameter of a running tool, a torque transfer ring of the pair of rotary drive rings including a series of sloping teeth that removably couple to the mandrel type casing hanger, the pair of rotary drive rings transferring torque to the casing string to rotate the casing string in a right-handed direction during one of running of the casing string, cementing of the casing string or a combination thereof, and the pair of rotary drive rings transferring axial loads from the running tool to the mandrel type casing hanger and the casing string when the running tool is threaded to the mandrel type casing hanger. In some embodiments, rotation of the pair of rotary drive rings in a left-handed direction retracts the rotary drive rings as the torque transfer and suspension tool separates from the mandrel type casing hanger.

An illustrative embodiment of a method of rotating a casing string suspended in a downhole well includes securing a pair of rotary drive rings around an outer diameter of a running tool such that slanted teeth of the rotary drive rings extend into fluid bypass flutes of a mandrel casing hanger when the mandrel casing hanger is threaded to the running tool, cushioning a space between the pair or rotary drive rings with a compressible member, reciprocating the casing string by using the pair of rotary drive rings to transfer axial loads from the running tool to a casing string suspended below the mandrel casing hanger when the mandrel casing hanger is threaded to the running tool, abutting a vertical side of each slanted tooth of the slanted teeth of the rotary drive rings against the fluid bypass flutes to transfer torque from the running tool to the mandrel casing hanger and rotate the casing string in a right-handed direction, and retracting the pair of rotary drive rings by sliding a slanted side of the slanted teeth upward and away from the fluid bypass flutes to separate the running tool from the mandrel casing hanger when the running tool is rotated in a left-handed direction. In some embodiments, an upper ring of the pair of rotary drive rings is secured to the running tool, and a lower ring of the pair of rotary drive rings includes the slanted teeth. In certain embodiments, the space between the pair of rotary drive rings is below the upper ring and above the lower ring, and a plurality of the compressible members extend between them, the plurality of compressible members dispersed around the pair of rotary drive rings. In some embodiments, the plurality of compressible members are compressed during rotation in the left-handed direction. In certain embodiments, the casing string is rotated in the right-handed direction during cementing of the casing string.

In further embodiments, features from specific embodiments may be combined with features from other embodiments. For example, features from one embodiment may be combined with features from any of the other embodiments. In further embodiments, additional features may be added to the specific embodiments described herein.

BRIEF DESCRIPTION OF THE DRAWINGS

Advantages of the present invention may become apparent to those skilled in the art with the benefit of the following detailed description and upon reference to the accompanying drawings in which.

Figure 1:
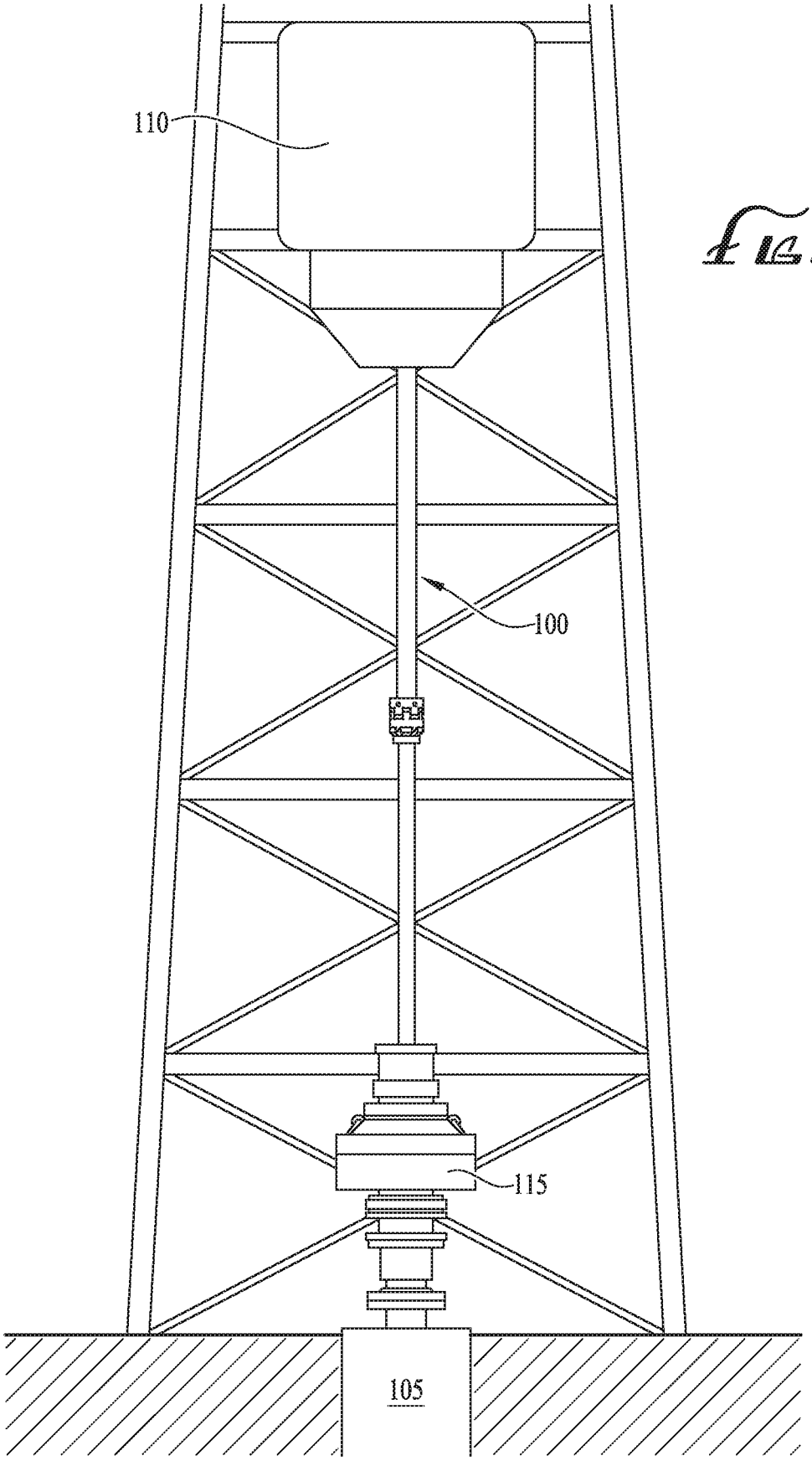
FIG. 1 is a perspective view of a casing string of an illustrative embodiment being run into an exemplary downhole well.

While the invention is susceptible to various modifications and alternative forms, specific embodiments thereof are shown by way of example in the drawings and may herein be described in detail. The drawings may not be to scale. It should be understood, however, that the embodiments described herein and shown in the drawings are not intended to limit the invention to the particular form disclosed, but on the contrary, the intention is to cover all modifications, equivalents and alternatives falling within the scope of the present invention as defined by the appended claims.

DETAILED DESCRIPTION

A casing string torque transfer and suspension system and method for mandrel casing hangers is described. In the following exemplary description, numerous specific details are set forth in order to provide a more thorough understanding of embodiments of the invention. It will be apparent, however, to an artisan of ordinary skill that the present invention may be practiced without incorporating all aspects of the specific details described herein. In other instances, specific features, quantities, or measurements well known to those of ordinary skill in the art have not been described in detail so as not to obscure the invention. Readers should note that although examples of the invention are set forth herein, the claims, and the full scope of any equivalents, are what define the metes and bounds of the invention.

As used in this specification and the appended claims, the singular forms "a", "an" and "the" include plural referents unless the context clearly dictates otherwise. Thus, for example, reference to a casing string includes one or more casing strings.

As used in this specification and the appended claims, "coupled" refers to either a direct connection or an indirect connection (e.g., at least one intervening connection) between one or more objects or components. The phrase "directly attached" means a direct connection between objects or components.

As used herein the terms "axial", "axially", "longitudinal" and "longitudinally" refer interchangeably to the direction extending along the length of the casing string.

As used in this specification and the appended claims, "right-handed" or "right-hand" refers to rotation in a clockwise direction when viewed from above the casing string.

As used in this specification and the appended claims, "left-handed" or "left-hand" refers to rotation in a counterclockwise direction when viewed from above the casing string.

For ease of description and so as not to obscure the invention, illustrative embodiments are primarily described in terms of a casing string suspended from a wellhead and extending into an oil and/or gas downhole well. However, the invention is not so limited. Illustrative embodiments may be equally applied to any casing string suspended by a mandrel-type casing hanger where rotation of the suspended casing string is desired in addition to reciprocation of the casing string.

Illustrative embodiments provide a pair of drive rings that transfer torque between a running tool and a casing string to rotate the casing string in a right-handed direction without over-torquing the threaded connection between the running tool and a mandrel casing hanger. The running tool may also carry the axial loads of the casing string and mandrel when the drive rings are engaged in the mandrel's fluid bypass flutes. The pair of drive rings may be secured around the outer diameter of the running tool body and may permit disengagement of the running tool from the mandrel casing hanger with a low-torque, left-handed rotation that may not unthread any other connections in the casing string. The pair of drive rings may include a set of asymmetrical, slanted teeth that extend into flutes of the mandrel casing hanger. Left-handed rotation of the running tool may cause the slanted teeth to slide upwards out of the flutes similar to a pawl mechanism. A cushioning member, such as compressible springs, arranged between each drive ring of the pair of drive rings may provide a torque transmission connection between the pair of drive rings and permit compression of the pair of drive rings as the running tool is disengaged from the mandrel casing hanger.

Illustrative embodiments may permit a casing string to be rotated during running and/or cementing of the casing string. Illustrative embodiments may provide a simplified system that reduces the amount of rods, pins, springs and other similar small parts that must be assembled and maintained at a wellsite or other field environment, providing for a more feasibly implemented solution. Illustrative embodiments provide a single pair of drive rings that may be applied to multiple casing sizes. Drive rings sized to fit around the outer diameter of the mandrel casing hanger may be employed with casings of varying diameter. Illustrative embodiments may be applied to mandrel casing hangers that are attached to running tools with either internal or external threading.

FIG. 1 illustrates a casing string of an illustrative embodiment being run into a downhole well. Casing string system 100 may be run into downhole well 105 by drilling rig 110. Drilling rig 110 may include a hydraulically driven top drive rotating mechanism to initiate rotation of casing string system 100 as described herein, and drilling rig 110 may also initiate reciprocation of casing string system 100 to lower casing string system 100 through wellhead 115 and into downhole wellbore 105.

Figure 2:
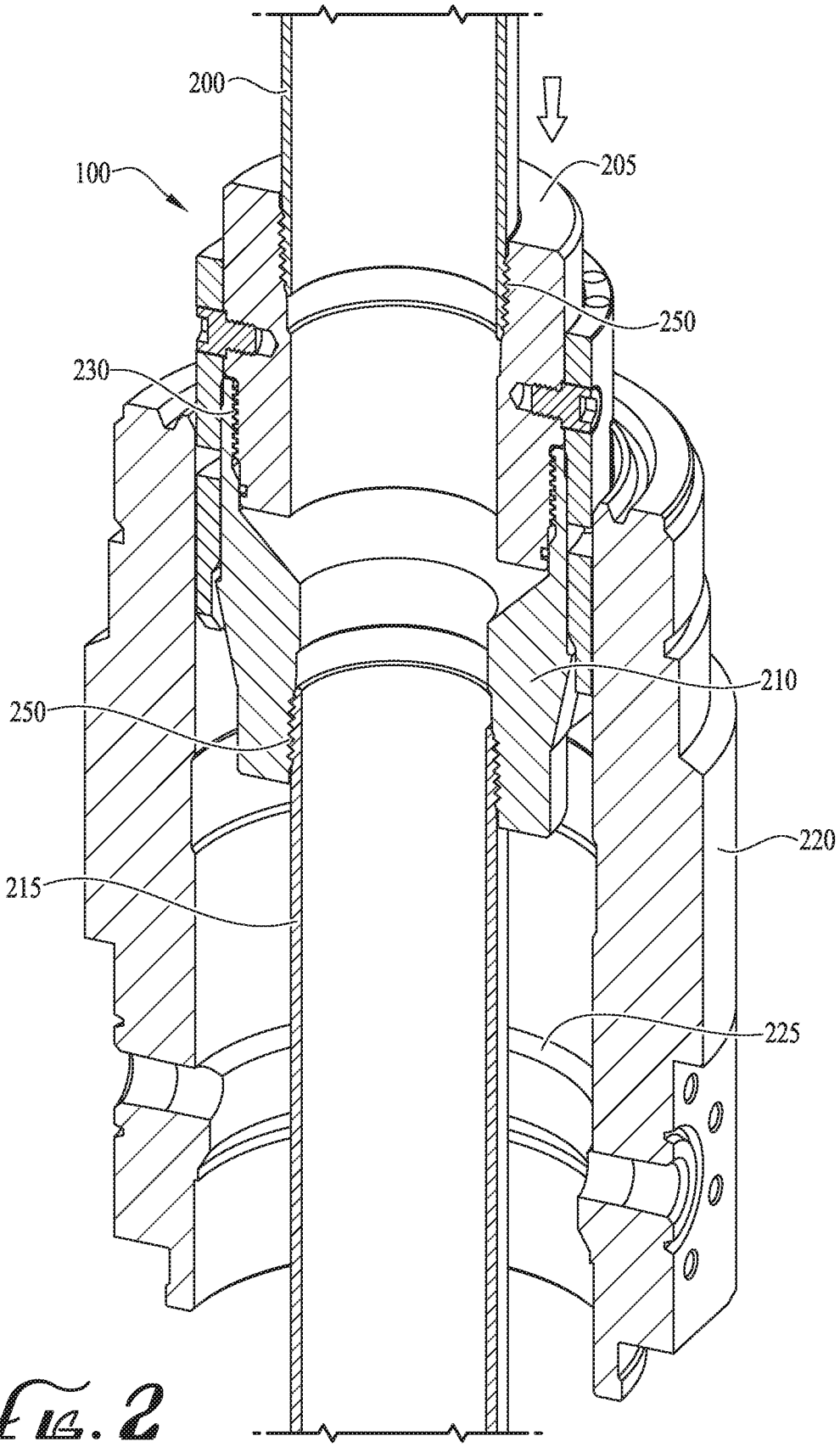
FIG. 2 is a perspective cross-sectional view of a casing string torque transfer and suspension system of an illustrative embodiment.

Turning to FIG. 2, casing string system 100 may include any one of outer casing, intermediate casing or production casing, any of which may be run and/or cemented using the system and methods of illustrative embodiments with a single sized pair of drive rings. Casing string system 100 may include upper casing section 200 with casing threads 250 at the bottom of upper casing section 200 connecting upper casing section 200 to running tool 205. Upper casing section 200 may connect and/or couple running tool 205 to drilling rig 110. Upper casing section 200 may permit manipulation of running tool 205 by drilling rig 110 and/or rotating and/or reciprocating mechanisms on drilling rig 110. Running tool 205 may be threaded and/or secured to the bottom end of upper casing section 200.

Running tool 205 may include a hollow, cylindrical body that connects to mandrel casing hanger 210 with handling threads 230. Mandrel casing hanger 210 may be a mandrel-type casing suspension threaded to running tool 205 with either internal or external handling threads 230, and extend below running tool 205. Handling threads 230 may be an acme profile thread and/or a trapezoidal thread profile for use with higher axial loads. Lower casing string 215 to be run into wellbore 105 may be threaded by casing threading 250 to mandrel casing hanger 210 and extend below mandrel casing hanger 210.

Wellhead 115 may include wellhead housing 220. The inner diameter of wellhead housing 220 may include shoulder 225. Mandrel casing hanger 210 may include a flange that seats onto shoulder 225 to suspend lower casing string 215 above wellbore 105 as lower casing string 215 extends into wellbore 105.

Figure 3:
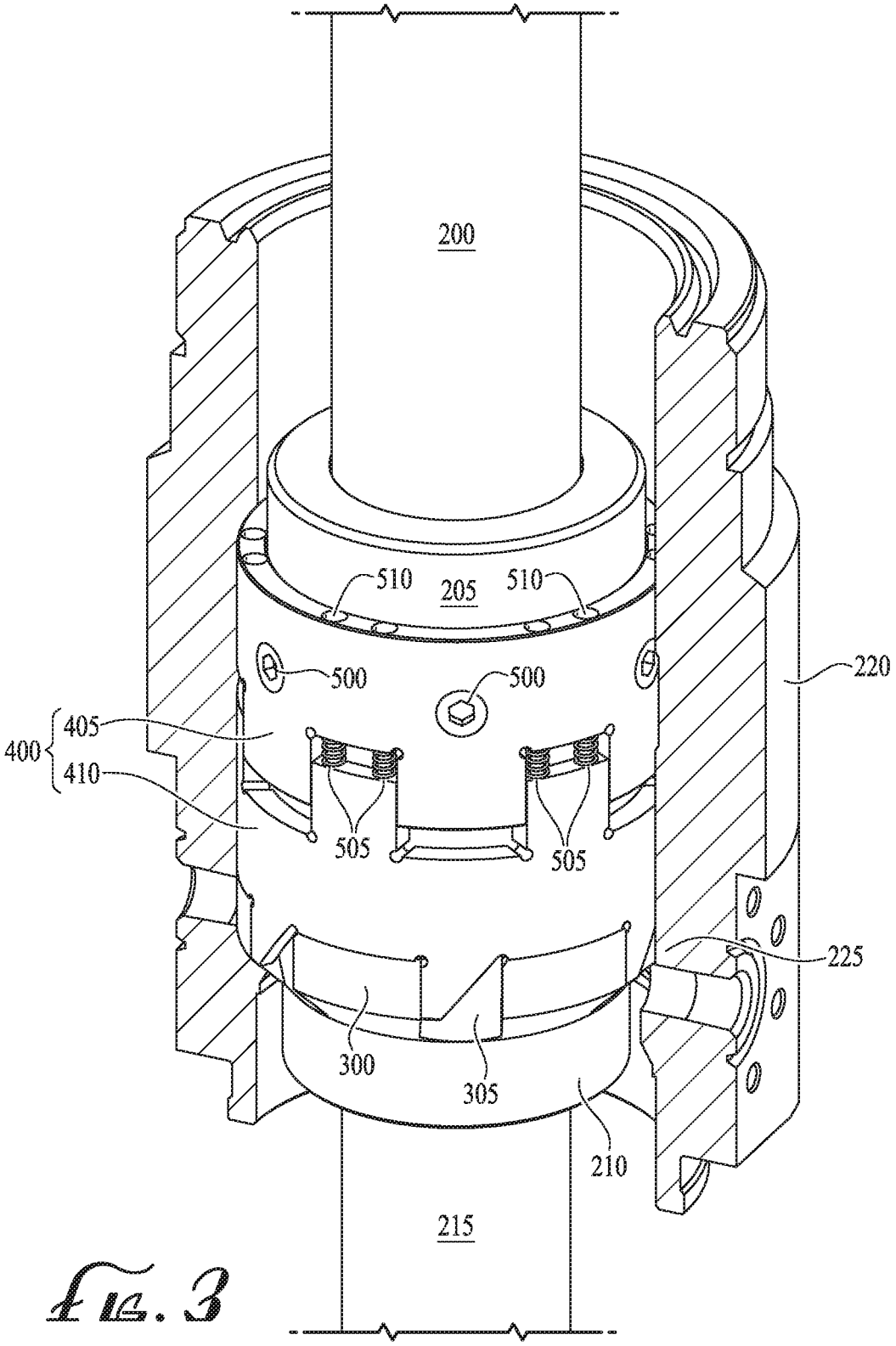
FIG. 3 is a perspective view of a casing string torque transfer and suspension system of an illustrative embodiment.

FIG. 3 illustrates mandrel casing hanger 210 seated onto shoulder 225 of wellhead housing 220. Mandrel casing hanger 210 may include flange 300 that seats onto shoulder 225 and suspends lower casing string 215 below mandrel casing hanger 210. Flange 300 may be a support surface on mandrel casing hanger 210 and include a plurality of flutes 305 spaced around flange 300. Shoulder 225 may take the weight of casing string 215 and center mandrel casing hanger 210. Flutes 305 may provide a fluid bypass for drilling fluid returns that may need to flow around mandrel casing hanger 210. A pair of rotary drive rings 400 may extend around the outer diameter of running tool 205 and/or mandrel casing hanger 210. Pair of rotary drive rings 400 may include an upper, drive ring member 405 and a lower, driven ring member (torque ring member) 410. Upper drive ring member 405 may be secured to running tool 205 by torque pins 500. Torque ring member 410 may be secured to drive ring member 405 by cushioning members 505 and/or retaining screws 510. Cushioning members 505 may be coil springs, elastomeric inserts or rings, pneumatic or hydraulic dampening elements, shocks, springs in other forms than coils such as stacked spring washers, conical spring washers and/or another similar compressible element.

Figure 4:
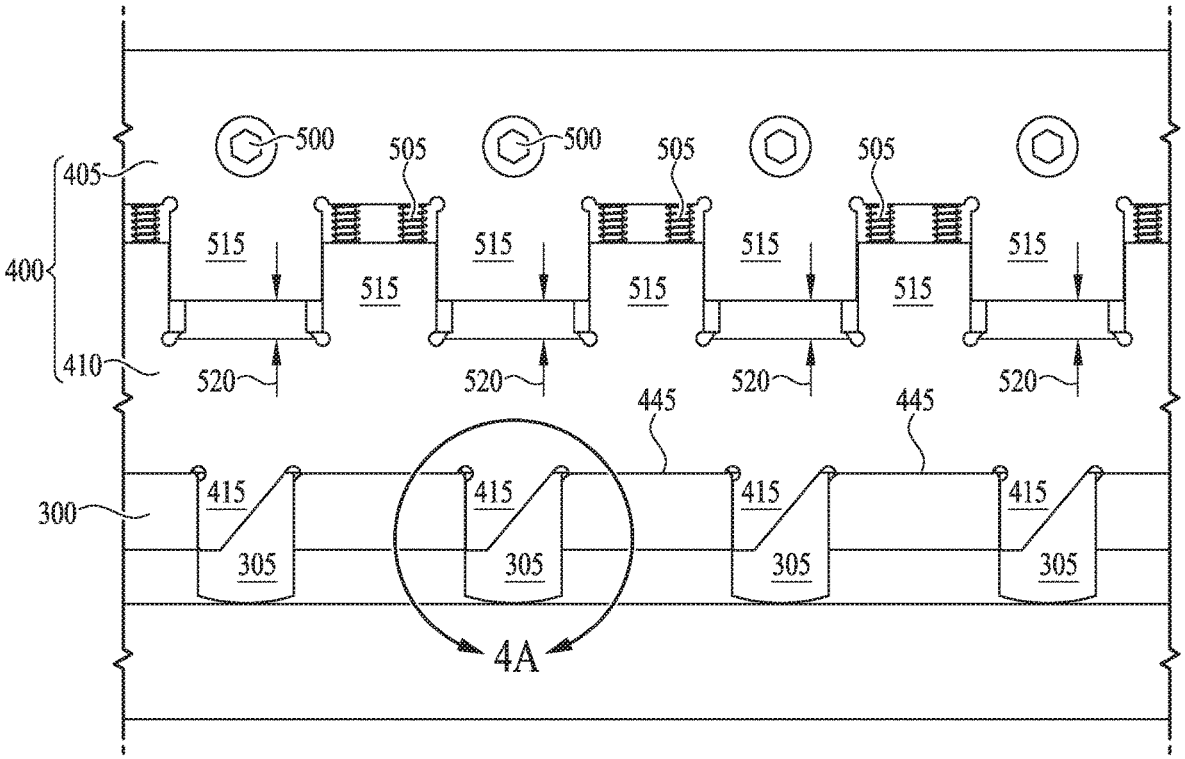
FIG. 4 is a schematic depiction of rotary drive rings of an illustrative embodiment.
Figure 9:
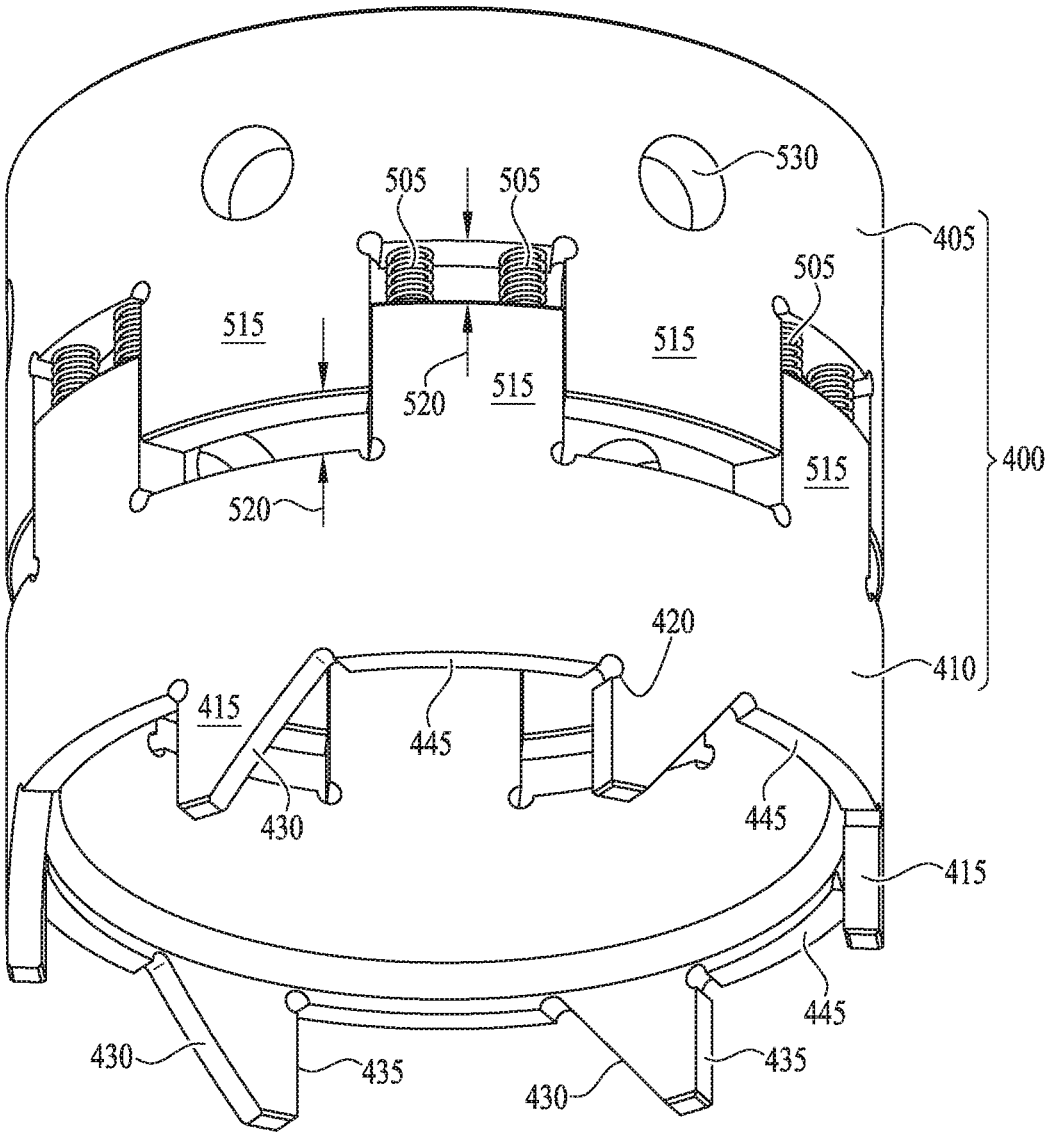
FIG. 9 is a perspective view of rotary drive rings of an illustrative embodiment.

FIG. 4 and FIG. 9 illustrate rotary drive rings 400 of illustrative embodiments. Rotary drive rings 400 may be tubular sleeves that fit around the outer diameter of running tool 205 and/or mandrel casing hanger 210. Drive ring member 405 and torque ring member 410 may be resiliently coupled to one another, with a space 520 between drive ring member 405 and torque ring member 410. Drive ring member 405 and torque ring member 410 may each include rectangular teeth 515 that interlock with one another, such that peaks of teeth 515 of drive ring member 405 sit within troughs between teeth 515 of torque ring member 410, and vice versa. One or more cushioning members 505 may extend between the peak of a tooth 515 of one ring member and the trough of a tooth 515 of the other ring member. For example, as shown in FIG. 4, a plurality of cushioning members 505 extend between each tooth 515 of torque ring member 410 and a trough between the teeth 515 of drive ring member 405. Tooth spaces 520 may be left between mated peaks and troughs of interlocked teeth 515 and/or cushioning members 505 may extend between tooth spaces 520.

Figure 4A:
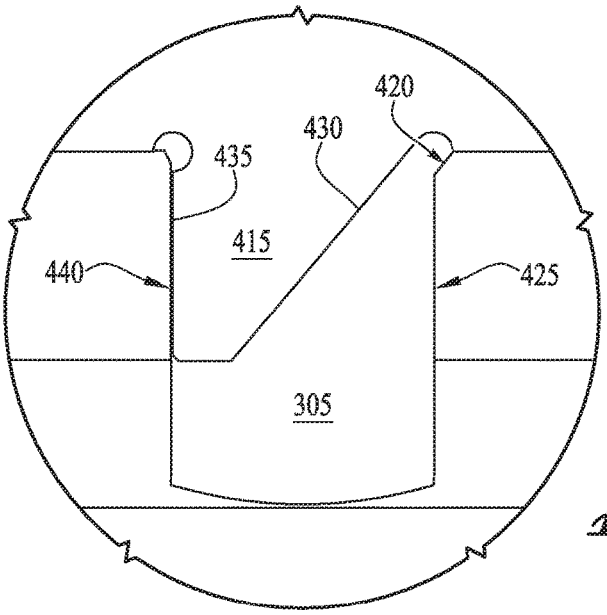
FIG. 4A is an enlarged view of a trapezoidal tooth of the exemplary rotary drive rings of FIG. 4.

Lower torque ring member (driven ring member) 410 may include a set of trapezoidal teeth 415 and/or protruding portions of torque ring member 410 that extend into flutes 305 of mandrel casing hanger 210. When engaged with mandrel casing hanger 210, torque ring member 410 may be arranged such that troughs 445 between trapezoidal teeth 415 rest and/or seat on the top of flange 300, and trapezoidal teeth 415 extend into flutes 305. One trapezoidal tooth 415 may extend into each flute 305 of mandrel casing hanger 210. In some embodiments, a trapezoidal tooth 415 may extend into every other flute 305 and/or only some flutes 305 may include a trapezoidal tooth 415. FIG. 4A illustrates a protruding portion and/or trapezoidal tooth 415 of an illustrative embodiment extending into flute 305. Flute 305 may include an axially extending driving wall 440 and an axially extending disengagement wall 425. Driving wall 440 may be in front of trapezoidal tooth 415 when running tool 205 and/or the pair of rotary drive rings 400 are rotated in a right-handed direction. Disengagement wall 425 may be in front of trapezoidal tooth 415 when running tool 205 and/or the pair of ring members are rotated in a left-handed direction. Driving wall 440 and disengagement wall 425 may generally be parallel one another aside from bevel 420. The top corner of disengagement wall 425 may include bevel 420, which bevel 420 may be angled at about 45° from vertical as bevel 420 extends away from driving wall 440.

Figure 6B:
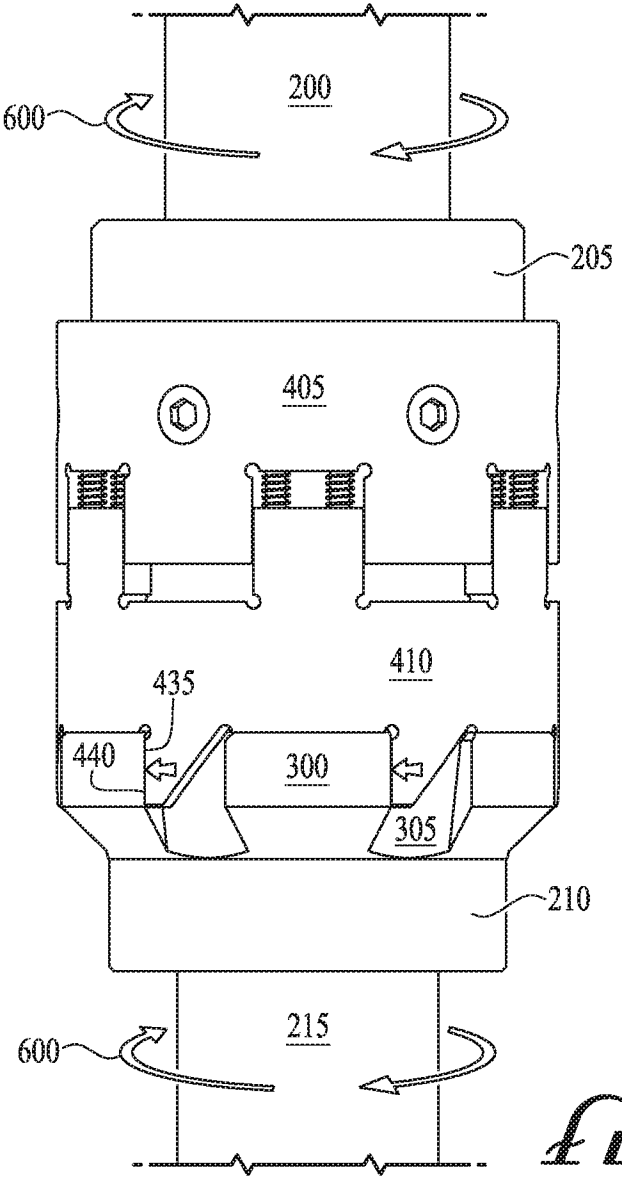
FIG. 6A-6B are perspective views of right-handed rotation of the casing string torque transfer and suspension system of an illustrative embodiment to rotate an exemplary casing string.
Figure 6A:
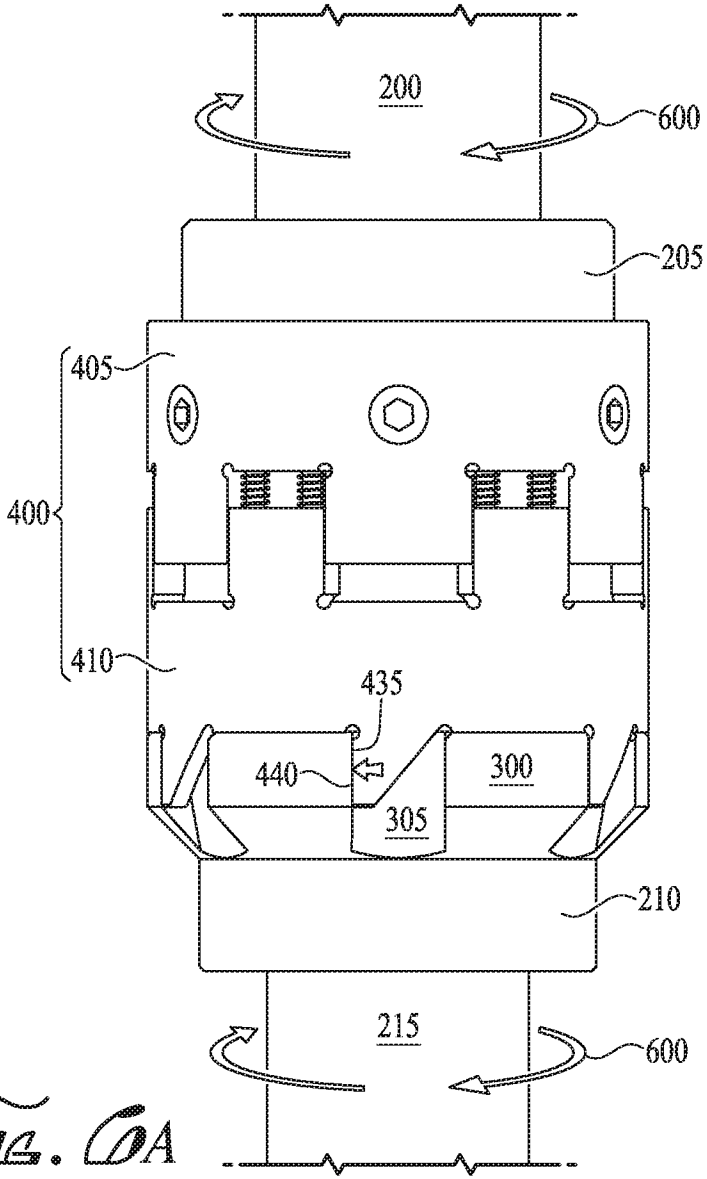

Trapezoidal tooth 415 may include an axially extending side 435 adjacent to driving wall 440. Axially extending side 435 may be parallel to driving wall 440 and/or abut driving wall 440, such that a torque transmission connection is formed when running tool 205 and/or rotary drive rings 400 are rotated in a right-handed direction. Rotation may be initiated by drilling rig 110 via manipulation casing 200. As shown in FIG. 6A and FIG. 6B, during right-handed rotation 600, torque may be transferred from running tool 205 to drive ring 405, from drive ring 405 to torque ring 410, and from torque ring 410 to mandrel casing hanger 210. During right-handed rotation 600, axially extending side 435 presses against driving wall 440 to turn mandrel casing hanger 210 along with casing string 215 in right-handed direction 600.

Returning to FIG. 4A and FIG. 9, slanted side 430 of trapezoidal tooth 415 may be positioned opposite to axially extending side 435, on the left-handed side of each trapezoidal tooth 415. Slanted side 430 may extend at an angel of about 45° from vertical as slanted side 430 extends away from driving wall 440. Slanted side 430 need not be precisely 45°, but should generally extend upwards and away from driving wall 440 in a about one-to-one ratio and/or in a one-to-one ratio. Bevel 420 should be angled to mate with slanted side 430 as slanted side 430 slides along bevel 420 when rotary drive rings 400 and running tool 205 are disengaged from mandrel casing hanger 210. During disengagement, trapezoidal tooth 415 may move in an upwards and left-handed direction. Slanted side 430 and/or bevel 420 may provide low-torque disengagement of running tool 205 from mandrel casing hanger 210 without loosening any other threaded connections 250 in casing string system 100.

Figure 7A:
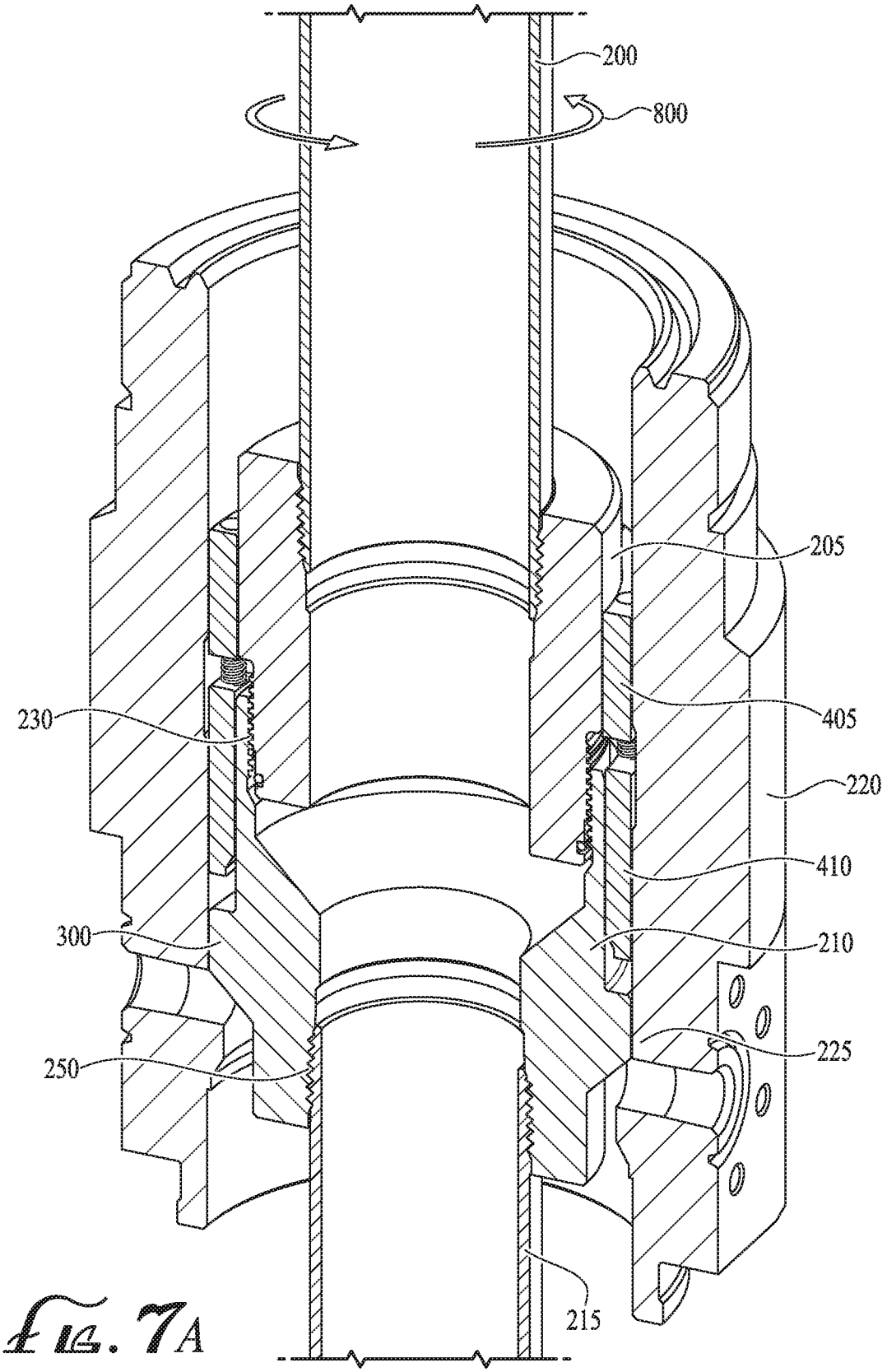
FIG. 7A-7B are perspective cross-sectional views of retraction of rotary drive rings of an illustrative embodiment during disconnection of an exemplary running tool from an exemplary mandrel casing hanger.
Figure 7B:
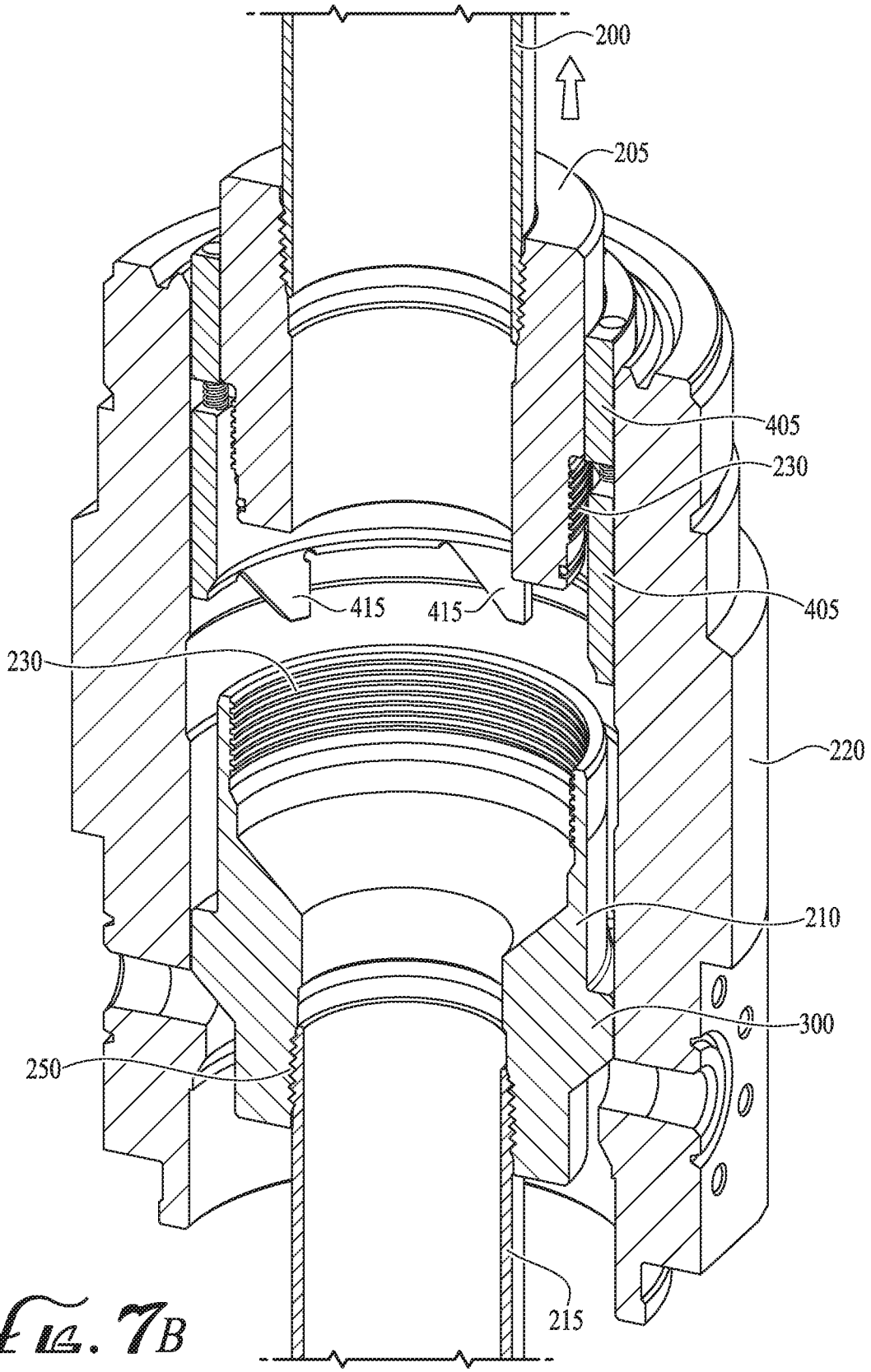
Figure 8B:
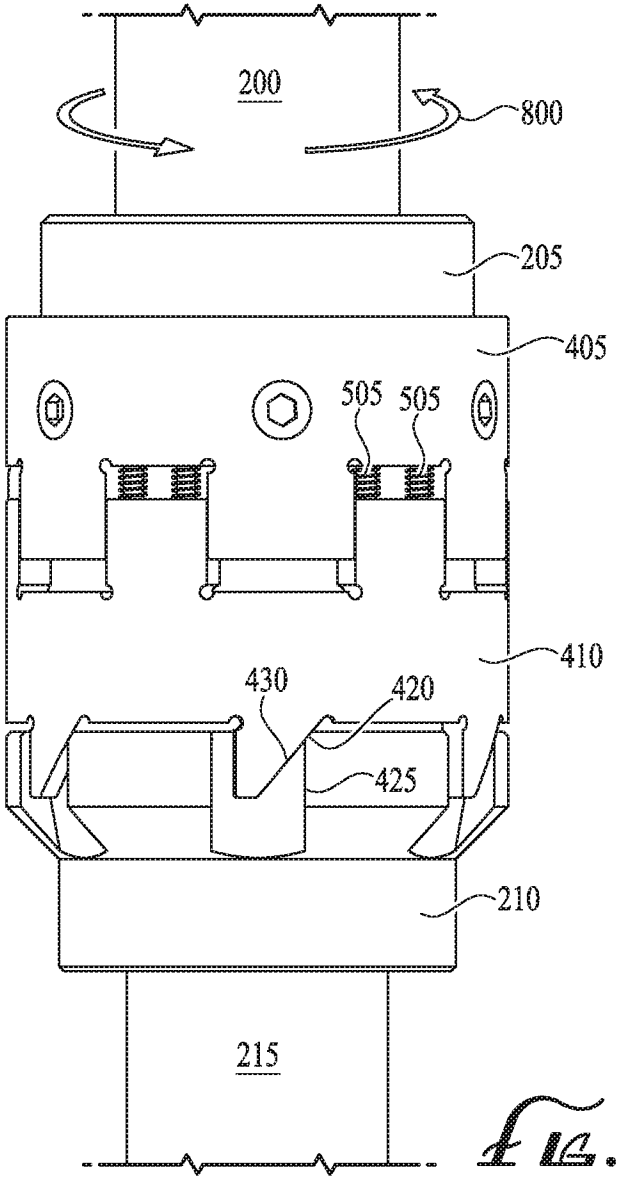
FIG. 8A-8D are perspective views of left-handed rotation of the casing string torque transfer and suspension system of an illustrative embodiment to disconnect an exemplary running tool.
Figure 8A:
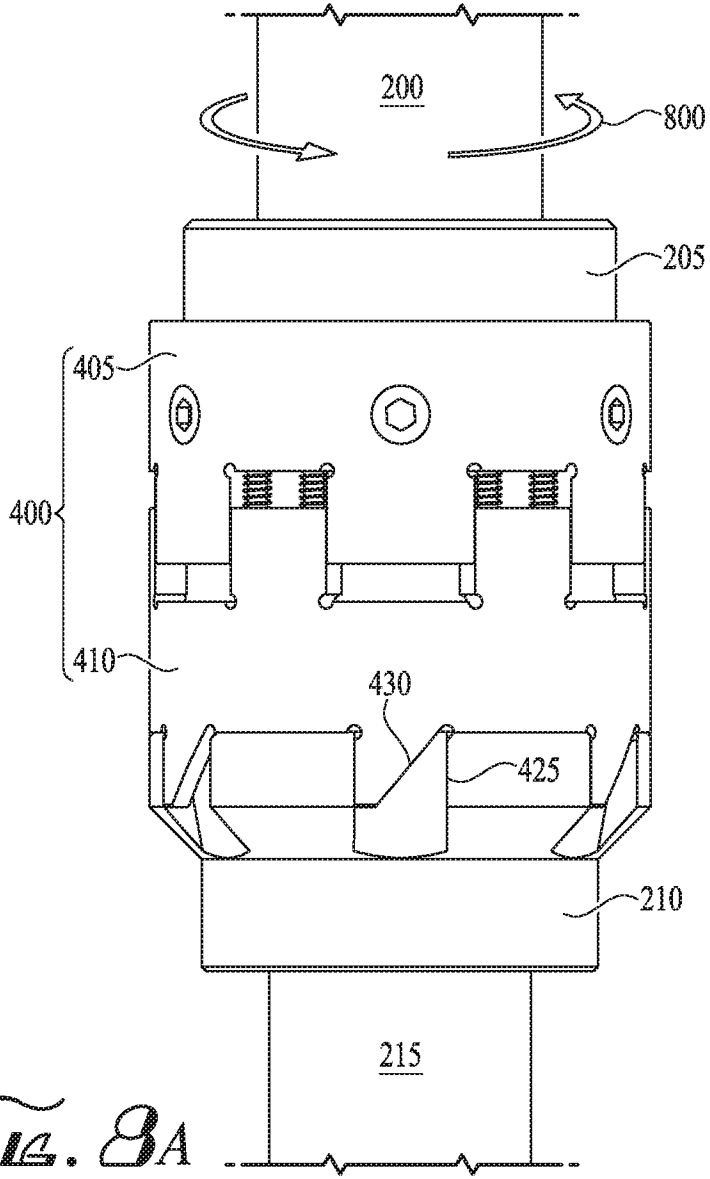
Figure 8D:
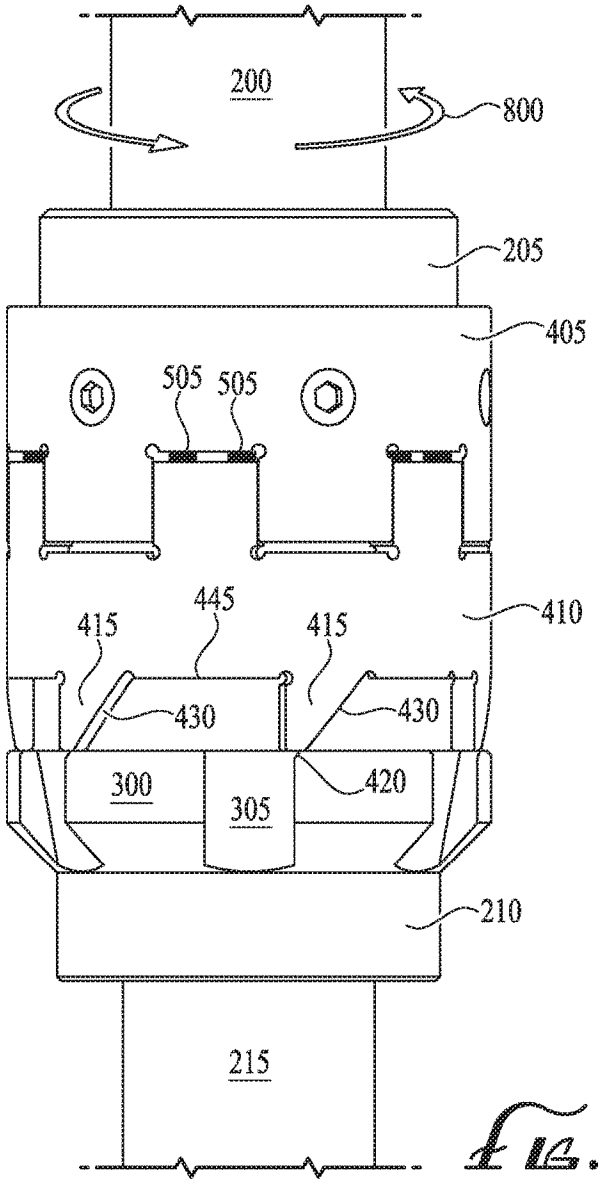
Figure 8C:
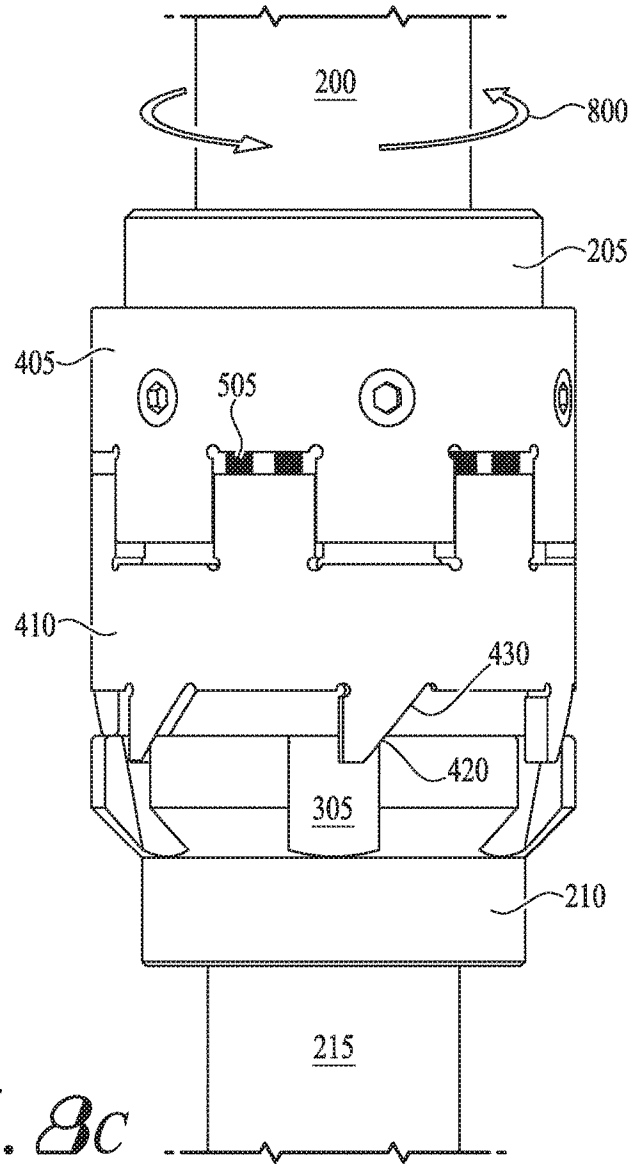

FIGS. 8A-8D illustrate disengagement of rotary drive rings 400 and running tool 205 from mandrel casing hanger 210 with left-handed rotation 800, and without rotation or unthreading of casing string 215 and/or casing threading 250. During retraction and/or disengagement of rotary drive rings 400 and running tool 205, mandrel casing hanger 210 and casing string 215 do not rotate and/or do not substantially rotate to ensure casing threading 250 between mandrel casing hanger 210 and casing string 215 and casing threading 250 within casing string 215 do not unthread. Upon initial left-handed rotation 800, slanted side 430 of trapezoidal teeth 415 may move to abut against bevel 420 of disengagement wall 425, as shown in FIG. 8A and FIG. 8B. During left-handed rotation 800, handling threads 230 may begin to loosen and running tool 205 with rotary drive rings 400 may begin to move upwards in addition to left-handed rotation 800. Torque transfer ring 410 may actuate upwards towards drive ring 405, such that cushioning members 505 begin to compress and/or space 520 begins to close. FIG. 8C and FIG. 8D illustrate continued left-handed rotation of running tool 205. Slanted side 430 of trapezoidal teeth 415 continues to slide along bevel 420 as torque ring 410 slides upwards and in left-handed direction 800 until running tool 205 separates and/or unthreads from mandrel casing hanger 210. FIG. 7A and FIG. 7B illustrate separation of running tool 205 from mandrel casing hanger 210 and unthreading of handling threads 230. Handling threads 230 between running tool 205 and mandrel casing hanger 210 may unthread to separate running tool 205 from mandrel casing hanger 210, leaving mandrel casing hanger 210 in place on wellhead 220 and casing string 215 suspended in downhole well 105. Threaded connections 250 within casing string 215 remain secure, threaded and/or connected due to the low-torque transfer provided by rotary drive rings 400. Retraction of running tool 205 may occur in about two, four or a similar number of revolutions, depending upon the pitch of acme profile handling threads 230 employed between running tool 205 and mandrel casing hanger 210.

Figure 5:
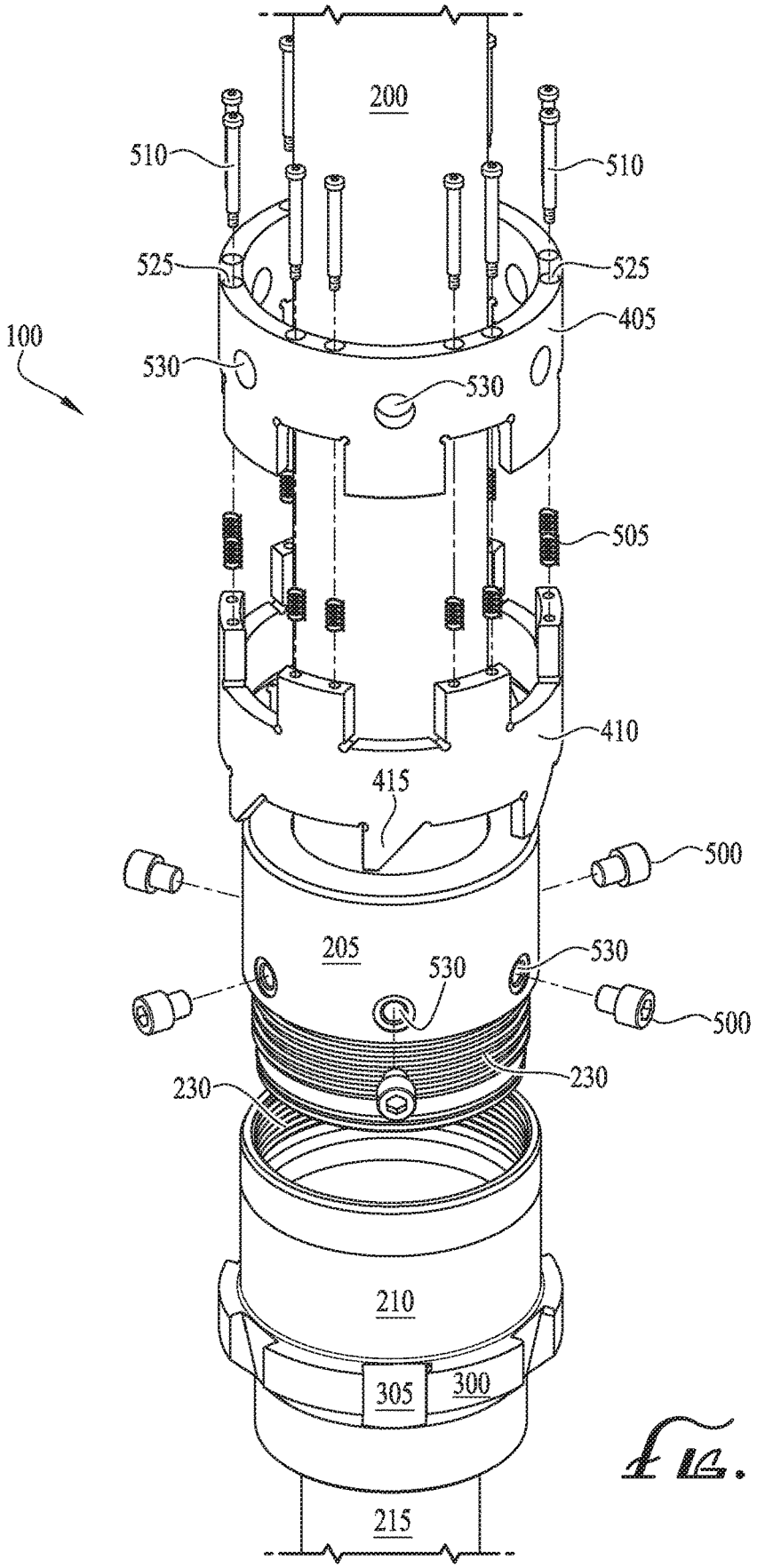
FIG. 5 is an exploded view of a casing string torque transfer and suspension system of an illustrative embodiment.

FIG. 5 illustrates an exploded view of a casing mandrel running tool system of illustrative embodiments. Drive ring member 405 may be fixed in place with torque pins 500 or another similar fastener to running tool 205. Torque pins may extend through apertures 530 in drive ring member 405 and/or running tool 205. Torque ring member 410 may not be directly attached to running tool 205, but instead be screwed to drive ring member 405 with retaining screws 510. Retaining screws 510 may be spaced circumferentially around and extend axially between rotary drive rings 400. Retaining screws 510 may be shoulder screws made up to torque ring member 410, and may be free to move axially with torque ring member 410 within their holes 525 made in drive ring member 405. Such axial motion between torque ring member 410 and drive ring member 405 may only occur during left-hand rotation, at which time cushioning members 505 may be compressed and torque ring member 410 may move closer to drive ring member 405. A plurality of cushioning members 505 may extend between drive ring member 405 and torque ring member 410. Retaining screws 510 may secure cushioning members 505 in place. Connections between drive ring member 405 and torque ring member 410 may permit axial and/or rotational movement between drive ring member 405 and torque ring member 410 to provide for low-torque rotation.

A casing string torque transfer and suspension system and method for mandrel casing hangers has been described. Further modifications and alternative embodiments of various aspects of the invention may be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the scope and range of equivalents as described in the following claims. In addition, it is to be understood that features described herein independently may, in certain embodiments, be combined.

What is claimed is:

1. A casing string torque transfer and suspension system comprising:

a pair of rotary drive rings secured circumferentially around a casing string running tool, the pair of rotary drive rings comprising a drive ring member coupled above a torque transfer ring member;

a plurality of cushioning members positioned in a space between the drive ring member and the torque transfer ring member;

the drive ring member secured to the casing string running tool; and the torque transfer ring member comprising a series of sloping teeth, each sloping tooth removably interspersed within fluid bypass flutes of a mandrel casing hanger.

2. The casing string torque transfer and suspension system of claim 1, further comprising the pair of rotary drive rings rotatable between:

a torque transfer position, wherein when the rotary drive rings are rotated in a first direction, the pair of rotary drive rings transfer torque from the casing string running tool to a casing string secured below the mandrel casing hanger; and a retracted position, wherein when the casing string running tool is rotated in a second direction the rotary drive rings retract to separate the casing string running tool from the mandrel casing hanger.

3. The casing string torque transfer and suspension system of claim 2, wherein in the retracted position the plurality of cushioning members compress and the series of sloping teeth disengage from the fluid bypass flutes.

4. The casing string torque transfer and suspension system of claim 3, wherein a sloped side of each sloping tooth of the series of sloping teeth slides along a beveled corner of a particular fluid bypass flute of the fluid bypass flutes as the series of sloping teeth disengage from the fluid bypass flutes to actuate into the retracted position.

5. The casing string torque transfer and suspension system of claim 1, wherein the casing string running tool is threadably connected to the mandrel casing hanger and a casing string is suspended below the mandrel casing hanger.

6. The casing string torque transfer and suspension system of claim 1, wherein the mandrel casing hanger seats on a shoulder of a wellhead housing at a surface of a downhole well, and further comprising a casing string threaded to the mandrel casing hanger, the casing string extending into the downhole well.

7. The casing string torque transfer and suspension system of claim 1, wherein each sloping tooth further comprises:

an axially extending edge parallel to a first wall of a particular fluid bypass flute in which the sloping tooth is removably interspersed; and a sloping edge opposite the axially extending edge, the sloping edge spaced from a second wall of the particular fluid bypass flute, the second wall parallel to the first wall and the sloping edge extending at about a forty-five degree angle from the second wall.

8. The casing string torque transfer and suspension system of claim 7, wherein a top corner of the second wall is beveled at about same angle as the sloping edge.

9. The casing string torque transfer and suspension system of claim 7, wherein rotating the rotary drive rings in a first direction abuts the axially extending edge against the first wall to transfer torque from the casing string running tool to a casing string secured below the mandrel casing hanger, and wherein rotating the rotary drive rings in a second direction slides the sloping edge along the second wall as the rotary drive rings retract to disengage the casing string running tool from the mandrel casing hanger.

10. The casing string torque transfer and suspension system of claim 1, wherein the pair of rotary drive rings transfer an axial load to a casing string secured below the mandrel casing hanger.

11. A casing string torque transfer and suspension system comprising:

a running tool threadable to a mandrel casing hanger, the mandrel casing hanger comprising:

a casing string threaded to the mandrel casing hanger and extending below the mandrel casing hanger;

a plurality of flutes dispersed circumferentially around a flange of the mandrel casing hanger; and a pair of rotary drive rings extending around an outer diameter of one of the running tool, the mandrel casing hanger or a combination thereof, the pair of rotary drive rings comprising:

an upper drive ring member pinned to the outer diameter of the running tool; and a lower driven ring member interlocked to the upper ring member below the upper ring member, the lower driven ring member comprising a set of protruding portions, each protruding portion of the set of protruding portions extending into one of the flutes when the running tool is threaded to the mandrel casing hanger;

wherein each flute comprises a pair of axially extending walls, and each protruding portion further comprises:

an axially extending side parallel to a first axially extending wall of the pair of axially extending walls, the axially extending side abuttable against the first axially extending wall such that rotation of the running tool in a first direction transfers torque through the abutment and rotates the casing string; and a sloping side opposite the axially extending side and spaced from a second axially extending wall of the pair of axially extending walls, such that rotation of the running tool in a second direction disengages the running tool from the mandrel casing hanger; and further comprising a bevel on a top corner of the second axially extending wall, wherein during rotation of the running tool in the second direction, the sloping side slides along the bevel as the lower driven ring member moves upward.

12. The casing string torque transfer and suspension system of claim 11, wherein the first direction is a right-handed rotation and the second direction is a left-handed rotation when viewed from above the casing string.

13. The casing string torque transfer and suspension system of claim 11, wherein the flange of the mandrel casing hanger is seatable on a wellhead housing shoulder.

14. The casing string torque transfer and suspension system of claim 13, wherein each flute of the plurality of flutes is a fluid bypass flute.

15. A casing string torque transfer and suspension system comprising:

a running tool threadable to a mandrel casing hanger, the mandrel casing hanger comprising:

a casing string threaded to the mandrel casing hanger and extending below the mandrel casing hanger;

a plurality of flutes dispersed circumferentially around a flange of the mandrel casing hanger;

a pair of rotary drive rings extending around an outer diameter of one of the running tool, the mandrel casing hanger or a combination thereof, the pair of rotary drive rings comprising:

an upper drive ring member pinned to the outer diameter of the running tool;

a lower driven ring member interlocked to the upper ring member below the upper ring member, the lower driven ring member comprising a set of protruding portions, each protruding portion of the set of protruding portions extending into one of the flutes when the running tool is threaded to the mandrel casing hanger;

a first set of rectangular teeth extending downward from the upper drive ring member, the first set of rectangular teeth interlocking with a second set of rectangular teeth that extend upward from the lower driven ring member; and a plurality of cushioning members extending axially between the upper drive ring member and the lower driven ring member, the plurality of cushioning members dispersed circumferentially around the pair of rotary drive rings.

16. The casing string torque transfer and suspension of claim 15, wherein each cushioning member of the plurality of cushioning members extends from a rectangular tooth of the lower driven ring member into a trough of the first set of rectangular teeth of the upper drive ring member.

17. A method of rotating a casing string suspended in a downhole well comprising:

securing a pair of rotary drive rings around an outer diameter of a running tool such that slanted teeth of the rotary drive rings extend into fluid bypass flutes of a mandrel casing hanger when the mandrel casing hanger is threaded to the running tool;

cushioning a space between the pair or rotary drive rings with a compressible member;

reciprocating the casing string by using the pair of rotary drive rings to transfer axial loads from the running tool to a casing string suspended below the mandrel casing hanger when the mandrel casing hanger is threaded to the running tool;

abutting a vertical side of each slanted tooth of the slanted teeth of the rotary drive rings against the fluid bypass flutes to transfer torque from the running tool to the mandrel casing hanger and rotate the casing string in a right-handed direction; and retracting the pair of rotary drive rings by sliding a slanted side of the slanted teeth upward and away from the fluid bypass flutes to separate the running tool from the mandrel casing hanger when the running tool is rotated in a left-handed direction.

18. The method of claim 17, wherein an upper ring of the pair of rotary drive rings is secured to the running tool, and a lower ring of the pair of rotary drive rings comprises the slanted teeth.

19. The method of claim 18, wherein the space between the pair of rotary drive rings is below the upper ring and above the lower ring, and a plurality of the compressible members extend therebetween, the plurality of compressible members dispersed around the pair of rotary drive rings.

20. The method of claim 19, wherein the plurality of compressible members are compressed during rotation in the left-handed direction.

21. The method of claim 17, where the casing string is rotated in the right-handed direction during cementing of the casing string.

* * * * *